US007232293B2

(12) United States Patent
Sasayama et al.

(10) Patent No.: US 7,232,293 B2
(45) Date of Patent: Jun. 19, 2007

(54) MANUAL HYDRAULIC PUMP

(75) Inventors: Katsuhiko Sasayama, Kobe (JP); Kenichi Shimada, Kobe (JP)

(73) Assignee: Marol Co., Ltd., Kobe (JP)

( * ) Notice: Subject to any disclaimer, the term of this patent is extended or adjusted under 35 U.S.C. 154(b) by 375 days.

(21) Appl. No.: 11/008,102

(22) Filed: Dec. 10, 2004

(65) Prior Publication Data

US 2006/0127233 A1 Jun. 15, 2006

(51) Int. Cl.
*F04B 39/10* (2006.01)
*F04B 53/10* (2006.01)

(52) U.S. Cl. ..... 417/569; 417/222.1; 417/269; 417/571; 417/455; 92/71

(58) Field of Classification Search ..... 417/222.1, 417/569, 571, 455; 92/71
See application file for complete search history.

(56) References Cited

U.S. PATENT DOCUMENTS 6,176,684 B1 * 1/2001 Zimmermann ..... 417/222.1
6,659,733 B1 * 12/2003 Takenaka et al. ..... 417/222.1
6,957,950 B2 * 10/2005 Kamiya et al. ..... 417/222.1

FOREIGN PATENT DOCUMENTS

JP 11-222197 8/1999

* cited by examiner

*Primary Examiner*—Michael Koczo
*Assistant Examiner*—Patrick Hamo
(74) *Attorney, Agent, or Firm*—Wenderoth, Lind & Ponack, L.L.P.

(57) ABSTRACT

A manual hydraulic pump includes a cylinder block 10 and an end block 8. The rear end of the cylinder block 10 and the end block 8 defines an end space 21 between them. The cylinder block 10 has cylinders 13 and oil passages 23. Each oil passage 23 extends between the rear end of one of the cylinders 13 and the end space 21. The end block 8 has a pair of cylindrical holes 27 opening into the end space 21. The end block 8 also has a pair of inlet/outlet ports 25 each communicating with the outside of the pump and one of the cylindrical holes 27. A distributing valve 22 is put in the end space 21 and spring-biased into compressive contact with the rear end of the cylinder block 10. The distributing valve 22 substantially takes the form of a disc and has a thickness smaller than the distance between the adjacent ends of the blocks 10 and 8. The distributing valve 22 has a pair of arcuate ports 22*a* formed on its front side. The arcuate ports 22*a* can communicate selectively with the oil passages 23 of the cylinder block 10 when this block turns. The distributing valve 22 also has a pair of cylindrical holes 22*c* formed on its rear side, each of which communicates with one of the arcuate ports 22*a*. A pair of pressing pistons 31 each include a rear cylindrical part 31*a* and a front cylindrical part 31*b*, which is smaller in diameter than the rear cylindrical part. The rear cylindrical part 31*a* is in axially slidable engagement with one of the cylindrical holes 27 of the end block 8, with an O-ring 33 interposed between this part and this block. The front cylindrical part 31*b* is in axially slidable engagement with one of the cylindrical holes 22*c* of the distributing valve 22, with an O-ring 32 interposed between this part and the valve. Each pressing piston 31 has an axial bore 31*c* cut through it.

2 Claims, 6 Drawing Sheets

(a)

(b)

MANUAL HYDRAULIC PUMP

FIELD OF THE INVENTION

The present invention relates to a manual hydraulic pump, which develops hydraulic pressure by being operated manually. The manual hydraulic pump may be used in the steering apparatus mainly of a small vessel such as a small fishing boat, a leisure boat or a yacht. More specifically, this invention relates to a helm pump for developing hydraulic pressure when the pump shaft is turned.

BACKGROUND OF THE INVENTION

For example, FIG. 6 of the accompanying drawings shows a manual hydraulic pump 50 as a prior art of the foregoing type. The pump 50 has a pump housing 51 consisting of a front housing 52 and a rear housing 53, which is fixed to the rear end of the front housing.

A shaft 54 extends through and is supported rotatably by the front housing 52. An inclined thrust bearing 60 is fitted in the front housing 52 and surrounds the shaft 54. The pump housing 51 houses a cylinder block 55, which is supported rotatably by the rear housing 53. The cylinder block 55 is fixed to the shaft 54 to rotate with it and has cylinders 56 open at their front ends. A cylindrical piston 57 (hatched in FIG. 3) can slide in each cylinder 56. The cylindrical piston 57 has a spherical head formed at its front end and is open at its rear end. A spring seat 58*a* is put in the cylindrical piston 57. A coil spring 58 is interposed between the spring seat 58*a* and the bottom of the associated cylinder 56 to bias the cylindrical piston 57 forward into compressive contact with the thrust bearing 60.

When the cylinder block 55 is turned with the shaft 54 in one direction, the cylindrical pistons 57 slide forward and backward to create hydraulic pressure. Specifically, one or more cylindrical pistons 57 slide backward against the force of the associated springs 58 to discharge hydraulic oil through the discharge port of the pump 50. At the same time, the other cylindrical pistons 57 are slid forward by the associated springs 58 to suck hydraulic oil through the suction port of the pump 50.

The discharge and suction of hydraulic oil are controlled by a distributing valve 59, which is fixed to the rear housing 53 by screws 59*a*. The cylinder block 55 turns with its rear end in contact with the distributing valve 59. A similar structure is disclosed in Japanese unexamined patent publication No. H11-222197 (paragraph 0017 and FIG. 3).

The operation of the pump 50 requires that each cylindrical piston 57 be biased forward by the associated spring 58, which is fitted in the associated cylinder 56. As a result, the pump 50 has a large number of parts and is complex in structure.

Air accumulates in the cylindrical pistons 57 and is not liable to escape from them. When the cylindrical pistons 57 slide backward, the air in them is compressed. As a result, hydraulic oil may be discharged intermittently from the pump 50, so that the pumping action may be intermittent.

As is the case with conventional pumps of this type, the distributing valve 59 is a disc. As stated already, the distributing valve 59 is fixed to the rear housing 53, and the cylinder block 55 turns in contact with this valve. Considerably high hydraulic pressure is exerted on the distributing valve 59. For this reason, in order to prevent leakage of hydraulic oil, it is necessary to finish with great accuracy the rear end surface of the cylinder block 55, the front and rear surfaces of the distributing valve 59, and the surface of the rear housing 53 that is in contact with the valve.

SUMMARY OF THE INVENTION

An object of the present invention is to provide a manual hydraulic pump which makes it easy to secure the accuracy of finishing required for the distributing valve and the surface of the cylinder block that is in contact with the valve, and from which oil is not liable to leak. Another object of the invention is to provide a manual hydraulic pump which has a simple structure and a small number of parts, and in which air is not liable to accumulate.

A manual hydraulic pump has a housing with a closed end and an open end. A shaft is supported rotatably by the housing and extends on a common axis through the closed end of the housing. The housing houses a cylinder block, which is supported rotatably by it. The cylinder block is coupled to the shaft coaxially with it to turn with it. The cylinder block has cylinders formed in it at regular intervals around the common axis. The cylinders extend in parallel with the common axis. Each of the cylinders has an open end remote from the open end of the housing and a closed end adjacent to the open end of the housing. The cylinder block also has an end surface adjacent to the open end of the housing. The cylinder block further has oil passages each extending between the end surface and the closed end of one of the cylinders. A pumping piston is in axially slidable engagement with each of the cylinders and can create hydraulic pressure when the shaft turns. The open end of the housing is closed by an end block. The end block and the end surface of the cylinder block define an end space between them. The end block has a pair of cylindrical holes opening into the end space. The cylindrical holes are opposite to each other diametrically of the common axis. The end block also has a pair of inlet/outlet ports each communicating with the outside of the pump and one of the cylindrical holes. A distributing valve is put in the end space and spring-biased into compressive contact with the end surface of the cylinder block. The distributing valve substantially takes the form of a disc and has a thickness smaller than the distance between the end block and the end surface of the cylinder block. The distributing valve has a pair of arcuate ports formed on its side adjacent to the cylinder block. The arcuate ports are opposite to each other diametrically of the axis of the valve. The arcuate ports can communicate selectively with the oil passages of the cylinder block when the cylinder block turns. The distributing valve also has a pair of cylindrical holes formed on the other side. These cylindrical holes are opposite to each other diametrically of the valve axis. Each of these cylindrical holes communicates with one of the arcuate ports. A pressing piston includes a large-diameter cylindrical part and a small-diameter cylindrical part, which is coaxial with and smaller in diameter than the large-diameter cylindrical part. The large-diameter cylindrical part is in axially slidable engagement with each of the cylindrical holes of the end block, with an O-ring interposed between this part and the end block. The small-diameter cylindrical part is in axially slidable engagement with each of the cylindrical holes of the distributing valve, with an O-ring interposed between this part and the valve. Each of the pressing pistons has an axial bore cut through it.

While the shaft is turning, hydraulic discharge pressure is applied on the end surface of the small-diameter cylindrical part of one of the pressing pistons, and hydraulic suction pressure is applied on the end surface of the large-diameter cylindrical part of the other pressing piston. The difference in area between the end surfaces of the two cylindrical parts develops force biasing the distributing valve into compressive contact with the end surface of the cylinder block.

While the shaft is not turning, no hydraulic pressure is applied on the pressing pistons, but the distributing valve is spring-biased into compressive contact with the end surface of the cylinder block.

Thus, the distributing valve is kept in compressive contact with the end surface of the cylinder block. This prevents hydraulic oil from leaking through the gaps between the distributing valve and the cylinder block even if the adjacent contact surfaces of these parts are finished with considerably low accuracy in comparison with the conventional accuracy.

In the conventional pump, because the distributing valve is joined and fixed to the rear housing to prevent oil leakage, the adjacent contact surfaces of these parts need finishing with very high accuracy.

In the pump according to the present invention, the large-diameter cylindrical part of each pressing piston is in axially slidable engagement with one of the cylindrical holes of the end block, with an O-ring interposed between this part and the end block. The connection of oil passages in this way makes it possible to considerably lower the accuracy with which the adjacent contact surfaces of the distributing valve and end block. As a result, it is possible to reduce the cost of production and reliably prevent oil leakage.

Each of the pumping pistons may have a spherical head and a neck that are remote from the closed end of the associated cylinder. The pump according to the present invention may further have a thrust bearing, a sleeve, a piston retainer and a coil spring. The thrust bearing is fitted in the housing and near its closed end. The thrust bearing surrounds the shaft and is inclined with respect to the common axis. The sleeve surrounds the shaft between the thrust bearing and the cylinder block rotatably with and slidably along the shaft. The piston retainer is in slidable engagement with the periphery of the sleeve and can move in all directions. The piston retainer is in engagement with the piston necks. The coil spring surrounds the shaft between the sleeve and the cylinder block so as to bias the pumping pistons toward the thrust bearing, thereby keeping the piston heads in compressive contact with the bearing.

Thus, the centrally located common spring biases the pumping pistons toward the thrust bearing. Accordingly, there is no need to fit a spring in each of the pumping pistons. This reduces the number of pump parts and simplifies the pump structure. The common spring uniformly biases the pumping pistons.

The pumping pistons may be either solid or hollow. If these pistons are hollow, their ends are closed, so that no air accumulates in the pistons.

BRIEF DESCRIPTION OF THE DRAWINGS

Preferred embodiments of the present invention are shown in the accompanying drawings, in which.

DETAILED DESCRIPTION OF PREFERRED EMBODIMENTS

Figure 1:
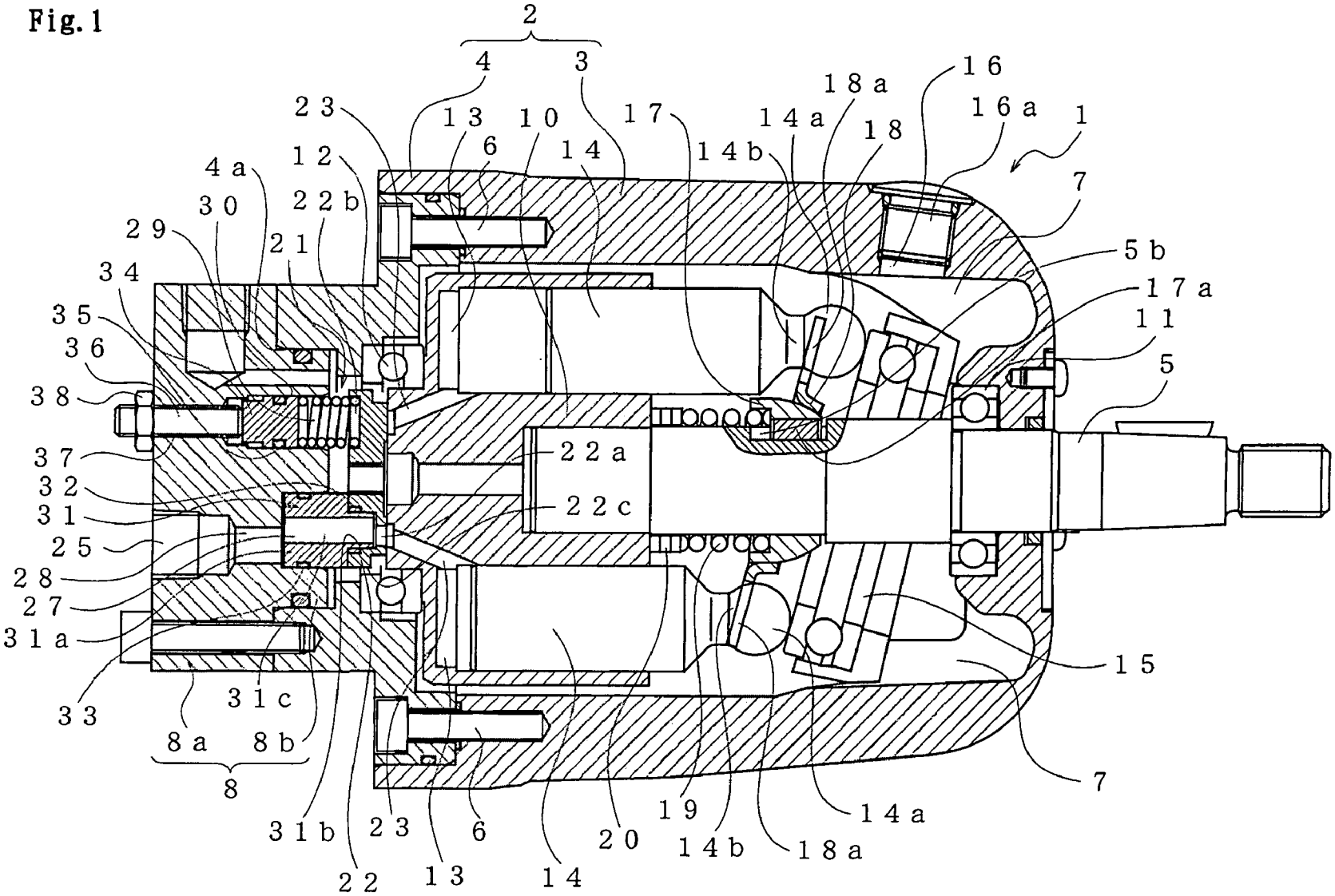
FIG. 1 is an axial section of a helm pump according to a first embodiment of the present invention.

With reference to FIGS. 1, a helm pump 1 as a manual hydraulic pump according to a first embodiment of the present invention is part of the steering apparatus of a small vessel (not shown). The helm pump 1 may be mounted on the dashboard in the steering room of the vessel.

The helm pump 1 has a pump housing 2, which includes a front housing 3 and a rear housing 4. The generally cylindrical space inside the pump housing 2 is an oil feeding tank 7. The front housing 3 has an oil feeding port 16 formed through its top and near its front end. A plug 16*a* engages removably with the feeding port 16.

A shaft 5 includes a front end portion 5*a*, which extends through the front end of the front housing 3. A steering wheel (not shown) is fixed to the front end of the shaft portion 5*a*.

The front housing 3 is open at its rear end, to which the rear housing 4 is fixed by bolts 6. The rear housing 4 has a cylindrical rear opening 4*a* formed in its rear end. A cylindrical end block 8 is fixed to the rear housing 4 by bolts 9. The end block 8 includes a rear part 8*a* and a front part 8*b*, which is smaller in diameter than the rear part and mates with the rear opening 4*a*.

The pump housing 2 houses a cylindrical cylinder block 10 as a main part of a pumping mechanism. The cylinder block 10 is coupled coaxially to the rear end of the shaft 5 to turn with the shaft. The shaft 5 and cylinder block 10 are supported rotatably by a front bearing 11 and a rear bearing 12, respectively, in the feeding tank 7.

The cylinder block 10 has cylinders 13, which may be three to seven in number, formed at regular intervals around its axis and extending axially of it. The cylinders 13 are open at their front ends and closed at their rear ends.

A pumping piston 14 is in axially slidable engagement with each cylinder 13. The pumping piston 14 has a spherical head 14*a* and a neck 14*b*. The pumping piston 14 may be either solid or hollow, and is closed at its bottom if it is hollow.

An inclined thrust bearing 15 is supported by an inclined bracket 15*a*, which is fixed in the feeding tank 7 and near the front end of the front housing 3. The top of the thrust bearing 15 is forward of the bottom of this bearing.

The shaft 5 has a key groove 5*b* formed in it midway between its front and rear ends. A key 17*a* is in engagement with the key groove 5*b*. A sleeve 17 surrounds the shaft 5 and can slide axially on it. The sleeve 17 is in engagement with the key 53*b* to turn with the shaft 5. The sleeve 17 has a spherical surface adjacent to its front end and a spring seat formed in its rear end. An annular piston retainer 18 is in rotatable and slidable engagement with the spherical surface. The piston retainer 18 has U-shaped outer recesses 18*a* formed through it at regular intervals around its axis. Each recess 18*a* is in engagement with one of the piston necks 14*b*. A coil spring 19 and spacers 20 surround the shaft 5 and are interposed between the spring seat of the sleeve 17 and the front end of the cylinder block 10. The coil spring 19 is forward of the spacers 20. The coil spring 19 biases the pumping pistons 14 forward to bring the piston heads 14*a* into compressive contact with the thrust bearing 15. This keeps the piston retainers 18 parallel with the thrust bearing 15.

When the shaft 5 turns in one direction, the cylinder block 10, pumping pistons 14 and piston retainer 18 turn with it, so that each piston 14 slides forward or backward with respect to the associated cylinder 13.

The rear housing 4 has an end space 21 formed through it between the adjacent ends of the cylinder block 10 and end block 8. A distributing valve 22 in the form of a disc is fitted in the end space 21. The thickness of the distributing valve 22 is smaller than the distance between the adjacent ends of the blocks 10 and 8 so that the valve can float (move in all directions) in the oil in the end space 21.

Figure 2:
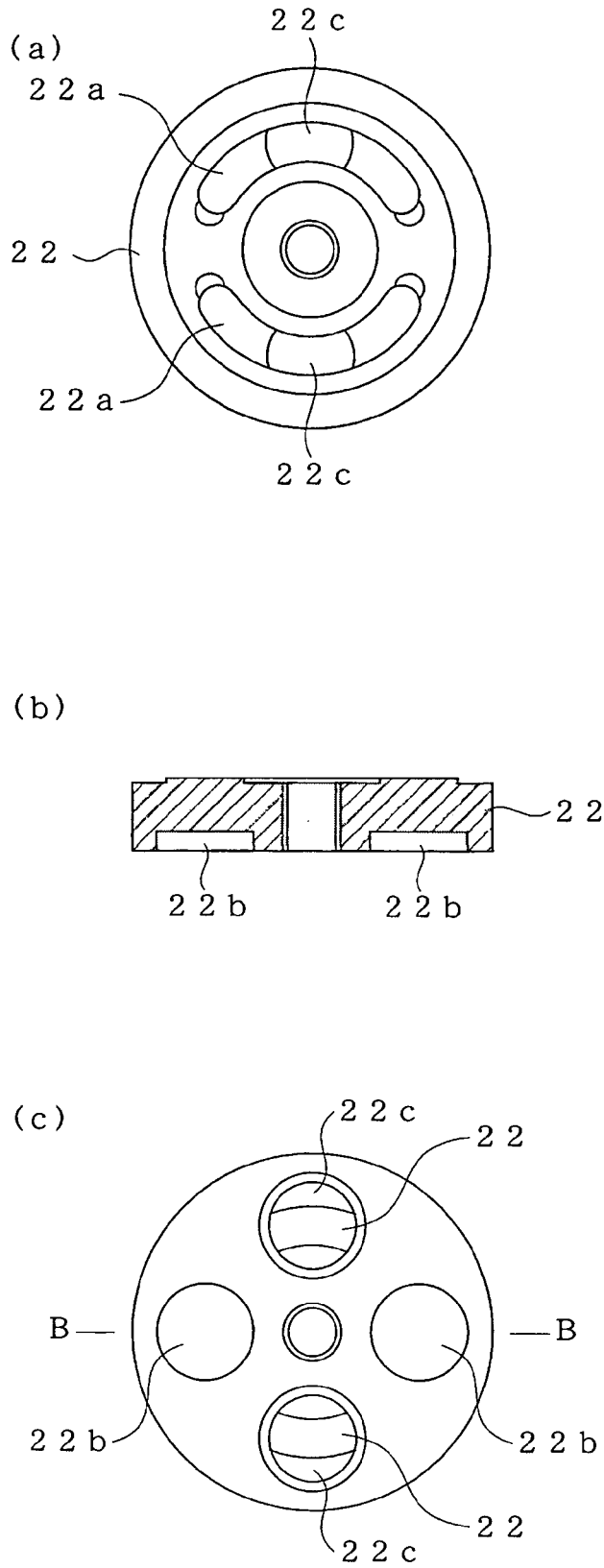
FIG. 2*a* is a front view of the distributing valve of the helm pump.
FIG. 2*b* is an axial section of the distributing valve along line B—B of FIG. 2*c*.
FIG. 2*c* is a rear view of the distributing valve.
Figure 3:
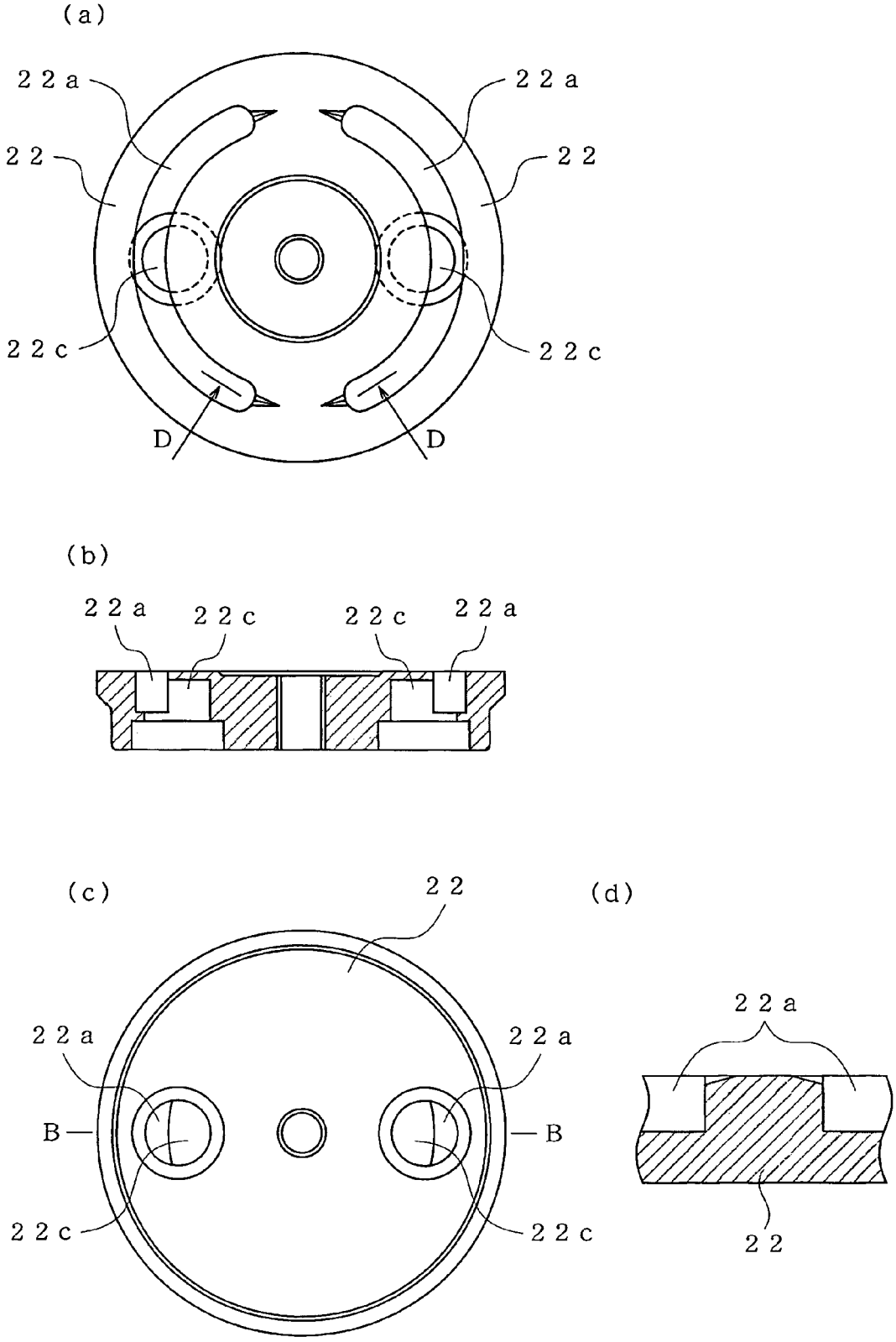
FIG. 3*a* is a front view of the distributing valve of a helm pump according to a second embodiment of the present invention.
FIG. 3*b* is an axial section of this valve along line B—B of FIG. 3*c*.
FIG. 3*c* is a rear view of this valve.
FIG. 3*d* is a sectional view along line D—D of FIG. 3*a;*

As best shown in FIG. 2*a*, the distributing valve 22 has a pair of arcuate ports 22*a* formed on its front side diametrically opposite each other. As best shown in FIG. 2*c*, the distributing valve 22 also has a pair of spring seats 22*b* formed on its rear side diametrically opposite each other and a pair of cylindrical holes 22*c* formed on this side diametrically opposite each other. Each spring seat 22*b* is positioned at a right angle from each cylindrical hole 22*c* around the axis of the distributing valve 22. Each cylindrical hole 22*c* communicates with one of the arcuate ports 22*a*.

The cylinder block 10 has oil passages 23 formed through it and each extending between the rear end of one of the cylinders 13 and the end space 21 of the rear housing 4. The rear ends of the oil passages 23 are so positioned that the passages can communicate with the arcuate ports 22*a* of the distributing valve 22.

The end block 8 has a pair of cylindrical holes 27 formed on its front side diametrically opposite each other and another pair of cylindrical holes 30 formed on this side diametrically opposite each other. Each cylindrical hole 27 is positioned at a right angle from each cylindrical hole 30 around the axis of the end block 8. The end block 8 also has a pair of inlet/outlet ports 25 formed on its rear side diametrically opposite each other. Each inlet/outlet port 25 communicates with one of the cylindrical holes 27 by means of an oil passage 28.

The distributing valve 22 in the end space 21 is biased forward into compressive contact with the rear end of the cylinder block 10 by two pressing pistons 31. Each pressing piston 31 includes a rear cylindrical part 31*a* and a front cylindrical part 31*b*, which is integral with and smaller in diameter than the rear cylindrical part. Each pressing piston 31 has an axial bore 31*c* formed through it. The front cylindrical part 31*b* of each pressing piston 31 is in axially slidable engagement with one of the cylindrical holes 22*c* of the distributing valve 22, with an O-ring 32 interposed between this part and the valve. The rear cylindrical part 31*a* of each pressing piston 31 is in axially slidable engagement with one of the cylindrical holes 27 of the end block 8, with an O-ring 33 interposed between this part and the end block.

The distributing valve 22 is also biased forward by two coil springs 29. The front end of each coil spring 29 is seated in one of the spring seats 22*b* of the distributing valve 22. A cylindrical spring shoe 34 is put axially slidably in each cylindrical hole 30 of the end block, with an O-ring 35 interposed between the shoe and the end block. The rear end of each coil spring 29 is in contact with the adjacent shoe 34. The end block 8 further has a pair of tapped holes 37 each extending between its rear end and one of the cylindrical holes 30. An adjusting bolt 36 is in engagement with each tapped hole 37. The rear end of the adjusting bolt 36 is in contact with the associated spring shoe 34. The rotation of the adjusting bolt 36 adjusts the force of the associated spring 29. A fixing nut 38 is in engagement with the adjusting bolt 36 and can be tightened to fix it.

As is the case with the conventional pump, when the shaft 5 turns in one direction, the cylinder block 10 turns to slide each pumping piston 14 forward or backward. This causes pressure oil to be discharged under high pressure from the feeding tank 7 through one of the inlet/outlet ports 25 and sucked through the other into the helm pump 1.

While the helm pump 1 is operating, hydraulic discharge pressure is applied on the front end of the front cylindrical part 31*b* of one of the pressing pistons 31, and hydraulic suction pressure is applied on the rear end of the rear cylindrical part 31*a* of the other piston. Because the hydraulic pressures per unit area on the two parts 31*a* and 31*b* are equal, the suction pressure on the rear end of the rear cylindrical part 31*a* prevails over the discharge pressure on the front end of the front cylindrical part 31*b*, which is smaller in area than the rear end. As a result, the distributing valve 22 is biased forward into compressive contact with the rear end of the cylinder block 10.

While the steering shaft 5 is not turning, so that the helm pump 1 is not operating, no hydraulic pressure is applied on the pressing pistons 31. The coil springs 29 exert a relatively weak force on the distributing valve 22 to bias it forward into compressive contact with the rear end of the cylinder block 10.

Thus, the helm pump 1 circulates hydraulic oil in the steering apparatus by discharging hydraulic oil from the pump into the main unit (not shown) of the steering apparatus and sucking hydraulic oil from this unit into the feeding tank 7 in the pump. Consequently, the vessel is steered.

When the shaft 5 turns in the opposite direction, hydraulic oil flows in the opposite direction through the inlet/outlet ports 25 and the main unit of the steering apparatus to steer the vessel in the opposite direction.

FIGS. 3*a*–3*d*, 4*a* and 4*b* show parts of a helm pump according to a second embodiment of the present invention. The parts of this pump that are common to the counterparts in the first embodiment are assigned the same reference numerals as the counterparts are. The description of these parts is omitted.

Figure 4:
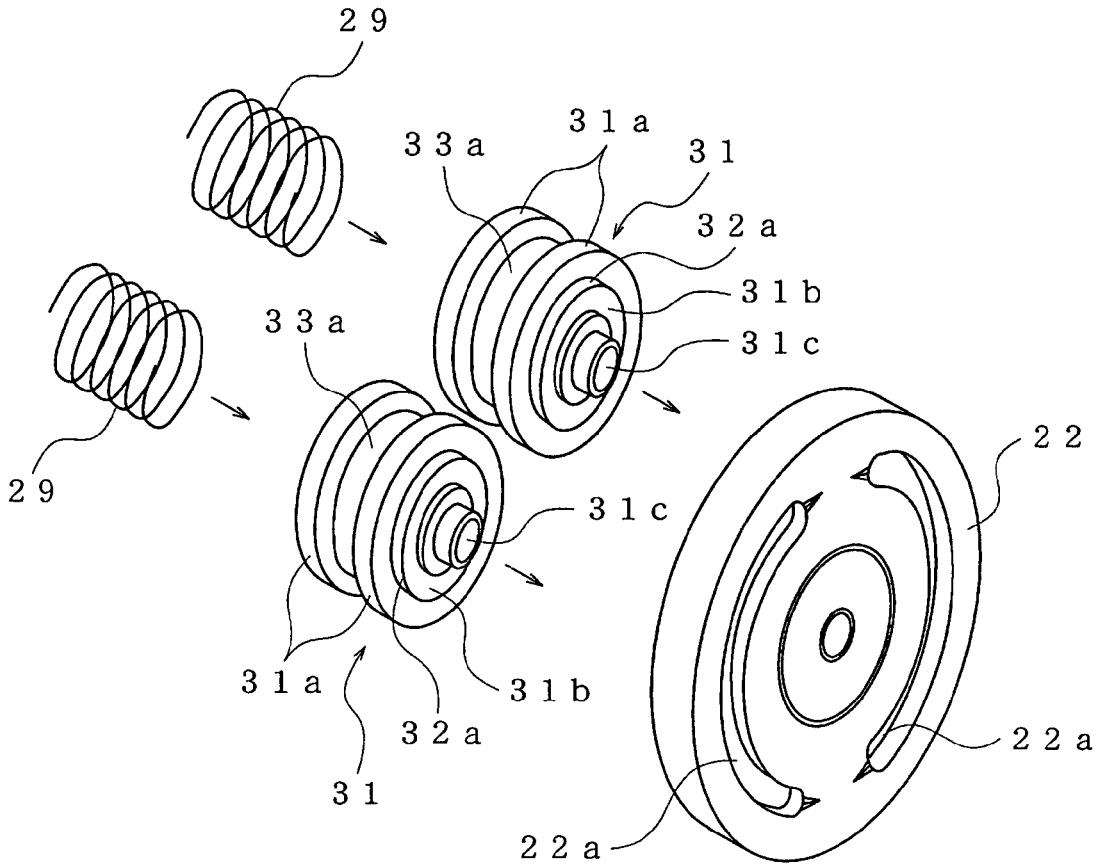
FIG. 4*a* is an exploded perspective view of the distributing valve, pressing pistons and coil springs of the helm pump according to the second embodiment.
FIG. 4*b* is an enlarged axial section of one of the pressing pistons.
Figure 4:
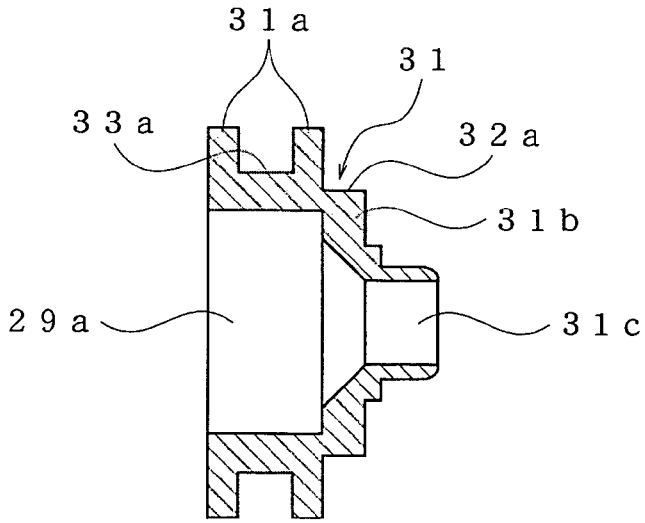

Each pressing piston 31 is interposed between one of the cylindrical holes 22*c* of the distributing valve 22 and one of the cylindrical holes 27 of the end block 8. As shown in FIG. 4*b*, each pressing piston 31 has a spring seat 29*a* formed on its rear side and O-ring grooves 32*a* and 33*a* formed in its periphery. A coil spring 29 is interposed between the spring seat 29*a* and the associated hole 27 to bias the distributing valve 22 forward. This makes it possible to omit the spring seats 22*b* of the distributing valve 22, the cylindrical holes 30 of the end block 8, the cylindrical spring shoes 34, the O-rings 35, the adjusting bolts 36 and the fixing nuts 38.

Figure 5:
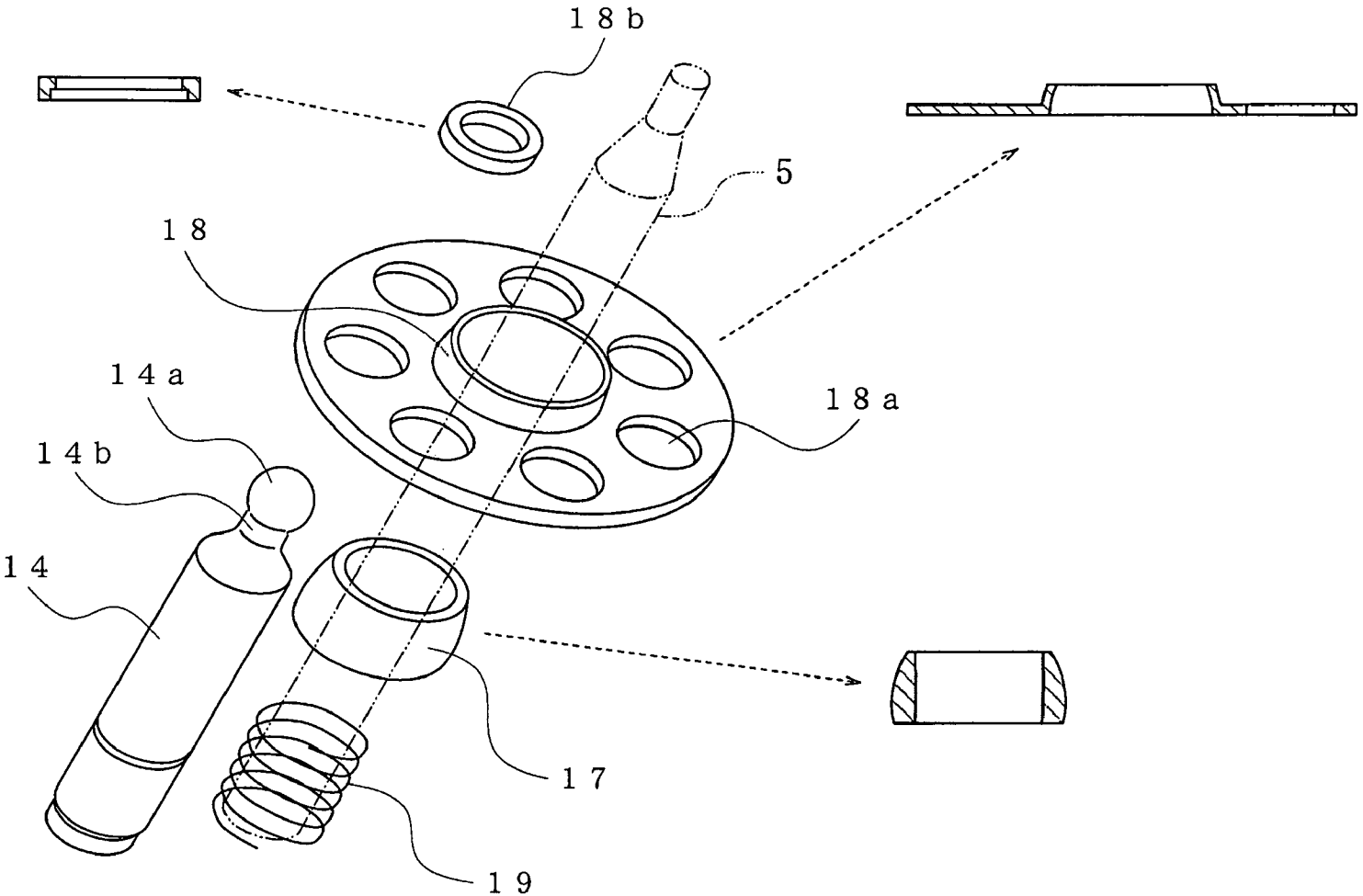
FIG. 5 is a perspective view of a modified piston retainer, showing partially in section how the pumping pistons engage with the retainer.
Figure 6:
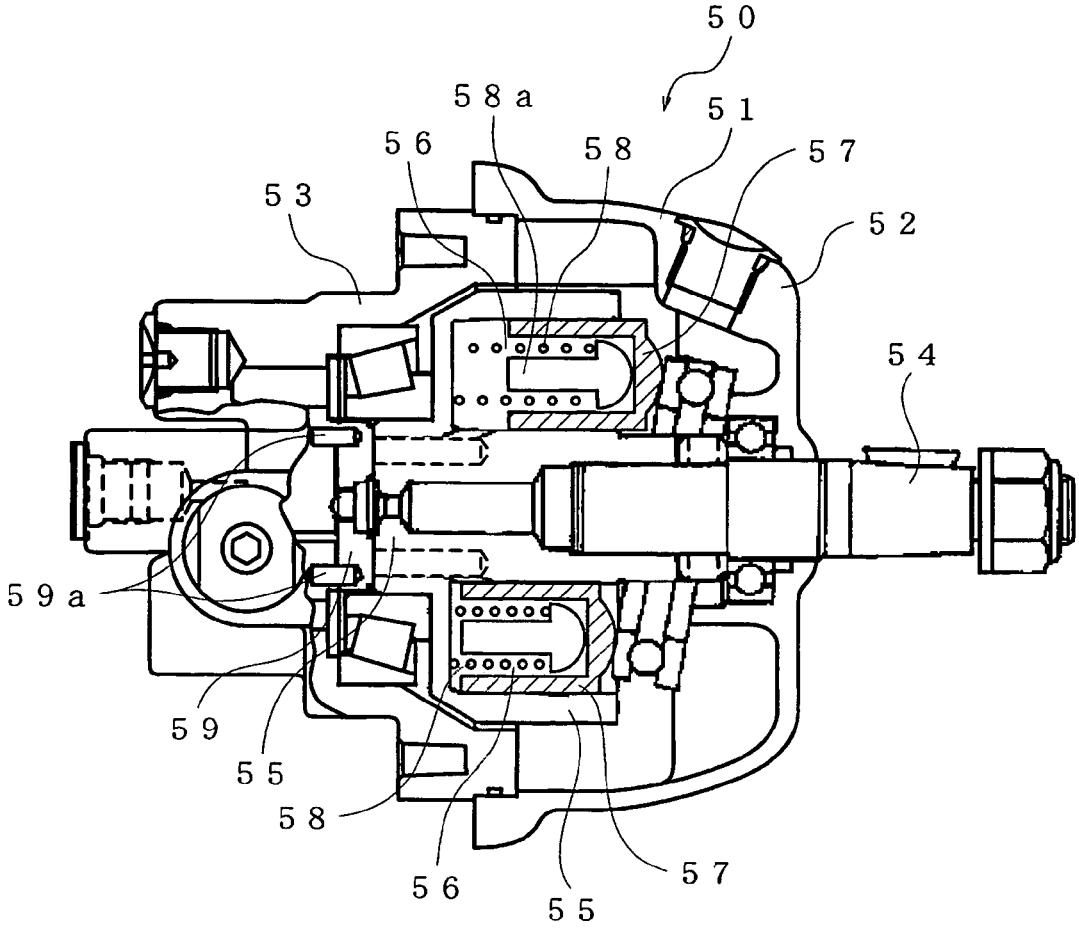
FIG. 6 is an axial section of a conventional helm pump.

FIG. 5 shows a modified piston retainer 18, which has circular holes 18*a* formed through it at regular intervals around its axis. After each piston neck 14*b* is positioned in one of the retainer holes 18*a*, a flexible ring 18*b* is fitted around the neck. The flexible ring 18*b* is larger in diameter than the retainer holes 18*a* so that the piston retainer 18 can axially move the pumping pistons 14.

The pumping pistons 14 are biased forward at the same time by the single spring 29 and single retainer 18. The piston necks 14*b* are in engagement with the retainer recesses or holes 18*a*. Thus, the helm pump 1 requires only one coil spring for the pumping pistons 14 and is consequently simple in structure. There is no need to cut a spring hole for engaging with a coil spring in the body of each pumping piston 14. Air may accumulate in the spring holes in the pistons of the conventional pump. The air accumulation may cause the discharge pressure of the pump to act intermittently on the steering apparatus while the apparatus is operating. The pumping pistons 14 of the helm pump 1 have no such spring holes, where air might accumulate.

In the conventional pump, the distributing valve is screwed to the rear housing. The rear end surface of the cylinder block of this pump, the front and rear surfaces of this valve, and the front end surface of this housing need finishing with very high accuracy to prevent oil leakage. The distributing valve 22 of the helm pump 1 is floating and biased into compressive contact with the rear end of the cylinder block 10 by the hydraulic pressure created while the pump is operating, and by the auxiliary spring force. As a result, even if the distributing valve 22 etc. are finished with lower accuracy, oil leakage can be prevented reliably. This makes it possible to produce the pump more easily at lower cost.

What is claimed is:

1. A manual hydraulic pump comprising:

a housing having a closed end and an open end;

a shaft supported rotatably by the housing and extending on a common axis through the closed end of the housing;

a cylinder block supported rotatably in and by the housing;

the cylinder block coupled to the shaft coaxially therewith to turn therewith;

the cylinder block having cylinders formed therein at regular intervals around the common axis, the cylinders extending in parallel with the common axis, the cylinders each having an open end remote from the open end of the housing and a closed end adjacent to the open end of the housing;

the cylinder block further having an end surface adjacent to the open end of the housing;

the cylinder block further having oil passages each extending between the end surface and the closed end of one of the cylinders;

pumping pistons each engaging axially slidably with one of the cylinders and capable of creating hydraulic pressure when the shaft turns;

an end block closing the open end of the housing;

the end block and the end surface of the cylinder block defining an end space therebetween;

the end block having a pair of first cylindrical holes opening into the end space, the first cylindrical holes being opposite to each other diametrically of the common axis;

the end block further having a pair of inlet/outlet ports each communicating with the outside of the pump and one of the first cylindrical holes;

a distributing valve put in the end space and spring-biased into compressive contact with the end surface of the cylinder block;

the distributing valve substantially taking the form of a disc and having a thickness smaller than the distance between the end block and the end surface of the cylinder block;

the distributing valve having a pair of arcuate ports formed on the side thereof adjacent to the cylinder block, the arcuate ports being opposite to each other diametrically of the axis of the valve, the arcuate ports being capable of communicating selectively with the oil passages of the cylinder block when the cylinder block turns;

the distributing valve further having a pair of second cylindrical holes formed on the other side thereof, the second cylindrical holes being opposite to each other diametrically of the axis of the valve, the second cylindrical holes each communicating with one of the arcuate ports;

a pair of pressing pistons each including a large-diameter cylindrical part and a small-diameter cylindrical part that is coaxial with and smaller in diameter than the large-diameter cylindrical part, the large-diameter cylindrical part engaging axially slidably with one of the first cylindrical holes, the small-diameter cylindrical part engaging axially slidably with one of the second cylindrical holes;

the pressing pistons each having an axial bore cut therethrough;

first O-rings each interposed between the large-diameter cylindrical part of one of the pressing pistons and the end block; and second O-rings each interposed between the small-diameter cylindrical part of one of the pressing pistons and the distributing valve.

2. The manual hydraulic pump of claim 1 wherein each of the pumping pistons has a spherical head and a neck that are remote from the closed end of the associated cylinder, the pump further comprising:

a thrust bearing fitted in the housing and near the closed end of the housing;

the thrust bearing surrounding the shaft and inclined with respect to the common axis;

a sleeve surrounding the shaft between the thrust bearing and the cylinder block rotatably with and slidably along the shaft;

a piston retainer surrounding the sleeve and engaging therewith slidably in all directions;

the piston retainer engaging with the necks of the pumping pistons; and a coil spring surrounding the shaft between the sleeve and the cylinder block so as to bias the pumping pistons toward the thrust bearing, thereby keeping the spherical heads of the pumping pistons in compressive contact with the bearing.

* * * * *